US007330778B2

(12) United States Patent
Delpuech et al.

(10) Patent No.: US 7,330,778 B2
(45) Date of Patent: Feb. 12, 2008

(54) METHOD FOR DETERMINING THE OPERATING PARAMETERS OF A SYSTEM COMPRISING A COOLING CHAMBER

(75) Inventors: Bernard Delpuech, Maurepas (FR); Pascal Favier, Meylan (FR); Sylvain Fourage, Issy les Moulineaux (FR)

(73) Assignee: L'Air Liquide, Societe Anonyme a Directoire et Conseil de Surveillance pour L'Etude et L'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 10/553,029

(22) PCT Filed: Mar. 23, 2004

(86) PCT No.: PCT/FR2004/050121

§ 371 (c)(1),
(2), (4) Date: Aug. 29, 2006

(87) PCT Pub. No.: WO2004/092667

PCT Pub. Date: Oct. 28, 2004

(65) Prior Publication Data

US 2007/0124011 A1 May 31, 2007

(30) Foreign Application Priority Data

Apr. 7, 2003 (FR) ..... 03 04284

(51) Int. Cl.
*G05B 21/00* (2006.01)
*F25D 25/00* (2006.01)

(52) U.S. Cl. ..... 700/266; 62/62

(58) Field of Classification Search ..... 700/266, 700/273, 270, 271; 62/62
See application file for complete search history.

(56) References Cited

U.S. PATENT DOCUMENTS 4,966,003 A * 10/1990 Shima ..... 62/63
5,267,490 A * 12/1993 Howells ..... 73/863.52
5,377,492 A * 1/1995 Robertson et al. ..... 62/63
5,630,321 A * 5/1997 Miller ..... 62/63
5,809,787 A * 9/1998 Zittel ..... 62/63

(Continued)

FOREIGN PATENT DOCUMENTS

DE 253 938 2/1988

(Continued)

OTHER PUBLICATIONS

Author: H. Koivisto, J. DeKamp, A. Zeller Title: Cooling of the plasma chamber for the AECR-U type electron cyclotron resonance ion source ARTEMIS Date: Jun. 22, 2000.*

(Continued)

*Primary Examiner*—Thomas K. Pham
(74) *Attorney, Agent, or Firm*—Brandon S. Clark; Christopher J. Cronin

(57) ABSTRACT

A method for determining the operating parameters of a system for cooling articles. The temperature of the articles, as they leave a chamber, is predicted. The prediction is made on the basis of operating parameters of the chamber, thermodynamic and physical characteristics of the chamber, and thermodynamic and physical characteristics of the articles. The method may be used to determine the operating parameters for food freezing tunnels.

15 Claims, 5 Drawing Sheets

U.S. PATENT DOCUMENTS

| | | | | |
|---|---|---|---|---|
| 5,813,237 | A * | 9/1998 | Grace et al. | 62/52.1 |
| 6,214,400 | B1 * | 4/2001 | Zittel et al. | 426/509 |
| 6,233,966 | B1 * | 5/2001 | Delpuech et al. | 62/374 |
| 6,497,106 | B2 * | 12/2002 | Lang et al. | 62/63 |
| 6,675,589 | B1 * | 1/2004 | Howard | 62/63 |
| 6,796,142 | B2 * | 9/2004 | Burn | 62/380 |
| 6,895,775 | B2 * | 5/2005 | Newman et al. | 62/378 |

FOREIGN PATENT DOCUMENTS

| | | |
|---|---|---|
| EP | 0 167 405 | 1/1986 |
| EP | 0 667 501 | 8/1995 |
| EP | 0 849 554 | 6/1998 |
| EP | 1 108 998 | 6/2001 |
| FR | 2 760 272 | 9/1998 |
| FR | 2 771 478 | 5/1999 |

OTHER PUBLICATIONS

Author: Roger Toogood Title: Pro/MECHANICA Tutorial Structure Date: 2001 Publisher: SDC.*

Ramakrishnan S. et al. Institute of Electrical and Electronics Engineers: "*Prediction of process parameters for intelligent control of freezing tunnels using simulation*", Proceedings of the 2001 Winter Simulation Conference; WSC'01; Arlington, VA, Dec. 9-12, 2001, Winter Simulation Conference, NY, NY: IEEE, US, vol. 1 of 2 Conf. 34, Dec. 9, 2001, pp. 888-895; XP010573627.

Lovatt S. J. et al.: *Improved dynamic simulation of multi-temperature industrial refrigeration systems for food chilling, freezing and cold storage*:, International Journal of Refrigeration, Oxford, GB, vol. 21, No. 3, May 1998, pp. 247-260; XP004287247.

Ramakrishnan S. et al.: "*A tunnel freezing process with adaptive control—A stochastic modeling approach*", Proceedings of the Industrial Engineering Research Conference, 2002; XP0001176740.

Wee H. K. et al.: "*Fan speed control in a blast freezer using model reference control*", Proceedings of the 18th International Congress of Refrigeration, vol. 3, Aug. 10, 1991, pp. 997-1000; XP002264678.

* cited by examiner

METHOD FOR DETERMINING THE OPERATING PARAMETERS OF A SYSTEM COMPRISING A COOLING CHAMBER

BACKGROUND

The present invention relates to a procedure for determining operating parameters of an installation for thermally cooling articles.

The invention applies in particular to installations for deep-freezing food articles.

Known deep-freezing installations comprise, for example, a deep-freezing chamber or tunnel through which a belt conveyor passes, the articles to be frozen being deposited on said conveyor, which runs continuously or sequentially through the deep-freezing tunnel.

A cryogenic chamber uses an inert low-temperature fluid which exchanges heat directly by contact with the articles to be deep-frozen.

Conventionally, a cryogenic chamber uses either dry ice (at −80° C.), liquid air or liquid nitrogen (at −196° C.) as refrigerant. Dry ice allows fresh or deep-frozen products to be transported without fear of rupture of the refrigeration line. Liquid nitrogen and liquid air allow either the individual deep-freezing of food products, or the hardening of delicate, deformable or sticky products (of the ice-cream type, etc.).

The operating parameters of the installations form recipes created experimentally. A recipe stores the control parameters of an installation for a given production run.

At the present time, there is no sensor capable of continuously and contactlessly measuring the internal temperature of an article in such a way that the recipes can be determined by procedures of determining operating parameters that are then adjusted by means of tests performed on site, which tests are often destructive.

The procedures of determining recipes generally include a step of determining a setpoint for the exit temperature of the articles followed by a step of determining initial operating parameters and then the repetition of a test cycle, comprising a step of predicting the exit temperature of the articles, a step of comparing the predicted temperature with the setpoint and, should there be a difference, a step of modifying the operating parameters.

The test cycle is repeated until the operating parameters result in a predicted temperature substantially close to the setpoint temperature.

It should be noted that all these steps are deduced and carried out by the operator experimentally, taking into account his know-how, his experience and his knowledge.

If the system consisting of the chamber and the mechanism of loading the articles is examined, several parameters may have an influence on the exit temperature of the-article, namely the production rate, which, for a given loading factor, involves a variation in the residence time in the chamber, the flow rate of the fluid, which acts on the temperature profile, the entry temperature of the articles, the convective profile of the chamber, and the loading factor.

The system is therefore a multi-variable system and existing procedures of determining the parameters, and especially the step of predicting the exit temperature of the articles, do not take these elements into account.

In the prediction steps of the prior art, so as to handle single-variable systems, it has been necessary to consider both the convective profile and the loading factor as constants and to fix the production rate, the temperature of the articles at the inlet of the deep-freezing chamber, and also other operating parameters of the installations.

Consequently, the recipes determined by the existing procedures of determination are relatively imprecise and require the use of production of articles followed by destructive tests thereon.

SUMMARY

The present invention aims to remedy this problem by defining a procedure for determining the operating parameters that is precise and easily implemented.

For this purpose, the subject of the invention is a procedure for determining the operating parameters of an installation for the thermal cooling of articles, comprising a chamber through which said articles pass from an inlet to an outlet, using a cooling fluid, the procedure comprising:

- a step of determining a temperature setpoint for articles at the outlet of said chamber;
- a step of determining initial operating parameters for said installation; and
- a test cycle for testing the operating parameters, which comprises:
- a step of predicting the temperature of the articles at the outlet of said chamber,
- a step of comparing the setpoint temperature with the predicted temperature and
- if said comparison step reveals a difference greater than a predetermined threshold, a step of modifying the operating parameters of said installation, and a repeat of the test cycle, said prediction step being carried out on the basis of operating parameters of said chamber, of thermodynamic and physical characteristics of said chamber and of thermodynamic and physical characteristics of said articles.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

The invention includes a procedure for determining the operating parameters of an installation for the cooling of articles, as described above.

According to other features:

said prediction step includes a step of predicting the behavior of said chamber based on the solution of heat balance equations on elementary volume slices of said chamber, which is performed at least on the basis of thermodynamic characteristics of said cooling fluid and thermodynamic and physical characteristics of said chamber;

said step of predicting the behavior of said chamber is furthermore carried out on the basis of operating parameters of said installation;

said operating parameters of said installation represent at least one of the elements chosen from the group consisting of:

the speed of a conveyor for transporting said articles through said chamber;

the loading factor; and the ventilation of the atmosphere in said chamber;

said prediction step includes a step of predicting the behavior of said articles based on solving the discretized heat conservation equation, applied to a grid of spatial and temporal points constituting a mesh of said articles, which is carried out at least on the basis of thermodynamic and physical characteristics of said articles;

said step of predicting the behavior of said articles is furthermore carried out on the basis of operating parameters of said installation;

said operating parameters of said installation include the temperature of said articles at the outlet of said chamber;

said step of predicting the behavior of said articles is optimized by calculations involving the modification of said mesh of said articles using mathematical series;

said step of predicting the behavior of said articles is optimized by omitting the prediction calculations for spatial and temporal points of said mesh of said articles for which the enthalpy changes are below a predetermined threshold value;

said step of predicting the temperature of said articles at the outlet of said chamber is based on said step of predicting the behavior of said chamber and on said step of predicting the behavior of said articles;

said step of modifying the operating parameters includes a step of manually modifying at least some of the operating parameters;

said step of modifying the operating parameters comprises automatically modifying at least some of said operating parameters; and said step of modifying the operating parameters comprises modifying at least one of the parameters chosen from the group consisting of:

the flow rate of said cooling fluid;

the residence time of said articles in said chamber;

the flow rate of gas extracted from said chamber;

the gas speed-up;

the gas recirculation; and the balance between the amounts of incoming air and the amounts of outgoing gas.

Figure 1:
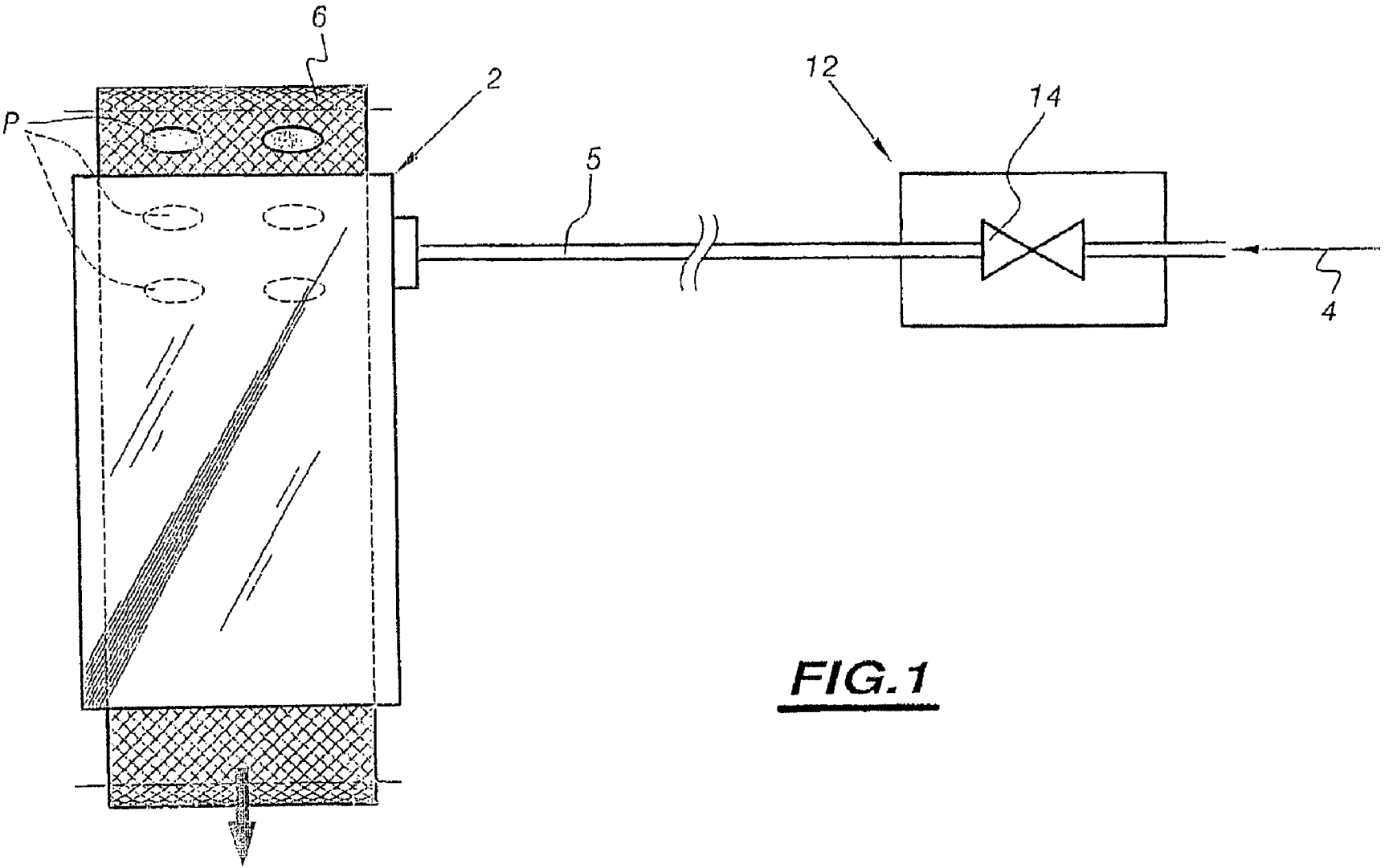
FIG. 1 illustrates a diagram of a typical cooling installation.

FIG. 1 shows a conventional installation for the treatment of food products, the operating parameters of which are determined by a procedure according to the invention.

This installation comprises a cryogenic chamber or tunnel 2, of conventional type, for freezing food articles P by contacting them with a cryogenic fluid 4 conveyed via a feed line 5 from any source.

For example, the chamber 2 has a rectangular parallelepipedal shape.

As mentioned above, the cryogenic fluid 4 used may, for example, be dry ice or liquid nitrogen and it is injected at one or more points into the chamber 2.

This chamber 2 is associated with a conveyor 6, of conventional type, for introducing the articles P into the chamber 2 and for extracting them, said conveyor operating either sequentially or continuously.

The installation has several operating parameters, namely the temperature profile in the chamber, the residence time of the articles P in the chamber 2 or the run speed of the conveyor 6, and the entry temperature of the articles P.

Finally, the installation includes means 12 for controlling the quantity of cryogenic fluid 4 injected into the chamber 2.

These means 12 include means 14 for controlling the flow rate of the cryogenic fluid 4. For example, the control means 14 consist of systems of solenoid valves or proportional valves of conventional type, placed on the feed line 5 for delivering cryogenic fluid 4.

Advantageously, the installation also includes a gas ventilation system, controlling, the gas flows, and the ventilation of the atmosphere in the chamber 2.

For example, this system is composed of specific ventilators, for speeding up the gases, of ventilators, which control the recirculation of the gases, and of a combination of ventilators and moving doors, which controls the balance between the amount of incoming air and the amount of outgoing gas.

Figure 2:
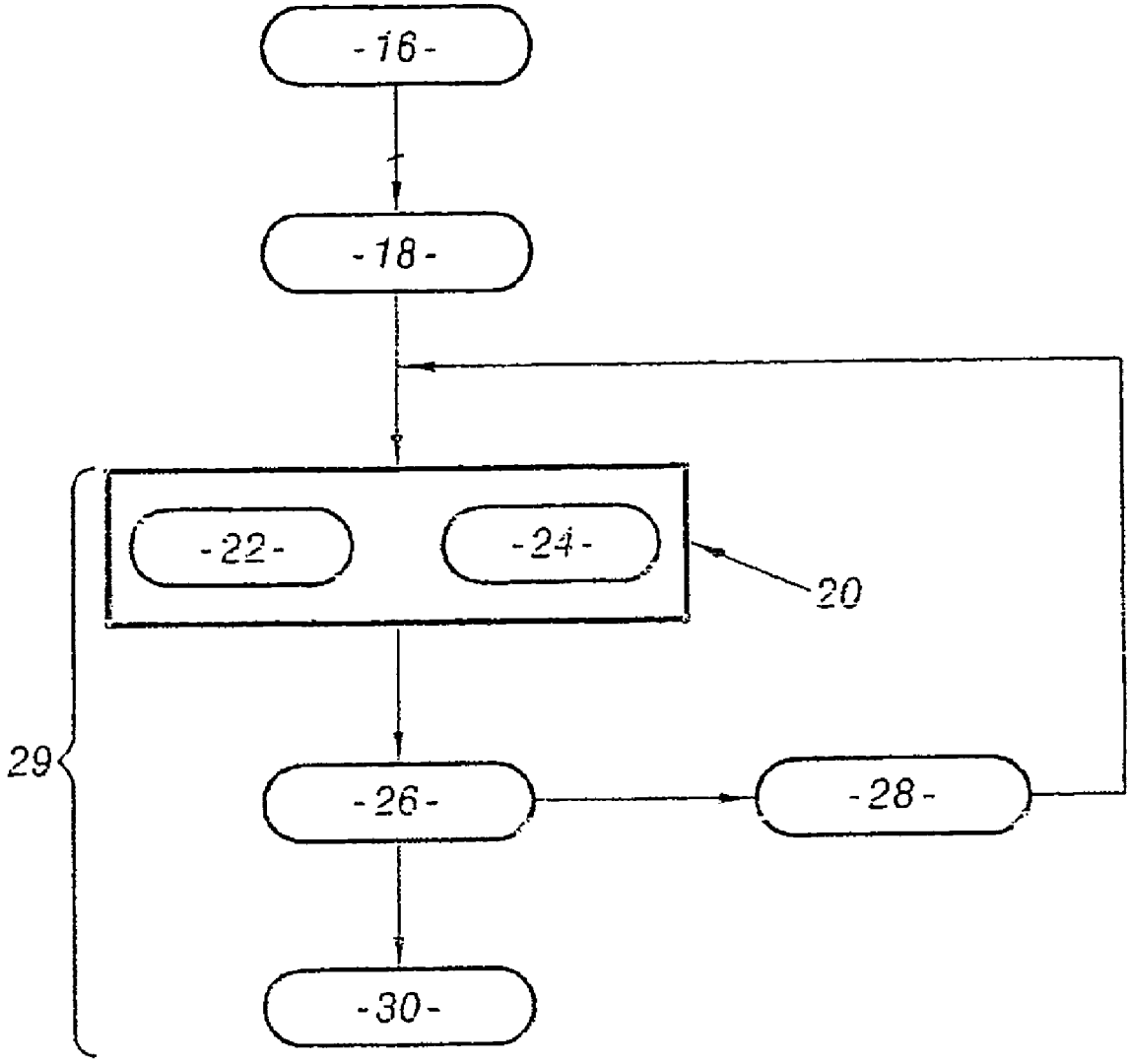
FIG. 2 illustrates a schematic representation, according to one embodiment of the current invention, of a method for determining the operating parameters of a cooling installation.

The general flowchart of the procedure for determining the operating parameters according to the invention will now be described with reference to FIG. 2.

This procedure starts with a step 16 of entering an exit temperature setpoint for the articles after thermal cooling.

The step 16 is followed by a step 18 of determining the initial operating parameters. The parameters determined during this step 18 are known parameters, such as mechanical characteristics of the chamber 2 or the physical and thermodynamic characteristics of the articles P, and variable parameters, such as the operating parameters of the installation, which are set arbitrarily.

The procedure then includes a step 20 of predicting the temperature of the articles P at the outlet of the chamber 2.

This step 20 includes a step 22 of predicting the behavior of the chamber 2 and a step 24 of predicting the behavior of the articles P.

Step 22 of predicting the behavior of the chamber 2 is used to predict by calculation, as will be described later with reference to FIG. 4, the theoretical temperature profile of the cryogenic fluid inside the chamber 2.

The results delivered by step 22 depend on the thermodynamic characteristics of the cryogenic fluid 4, on the convective characteristics of the chamber 2, on the characteristics of the means of injecting the cryogenic fluid 4, on the characteristics of the ventilation system and on the physical characteristics of the chamber 2.

Step 22 also takes into account the operating parameters of the installation, such as the speed of the conveyor 6.

Step 24 of predicting the behavior of the articles P is used to determine by calculation, as will be described later with reference to FIG. 3, enthalpy changes of the articles P according to their external environment and to their initial temperature.

Thus, the results delivered by step 24 of predicting the behavior of the articles P depend on their physical and thermodynamic characteristics.

Step 22 of predicting the behavior of the chamber and step 24 of predicting the behavior of the articles P are coupled to each other, as will be described in more detail with reference to 5, so as to deliver a theoretical temperature of the articles P at the outlet of the chamber 2.

Thus, the prediction made in step 20 of predicting the temperature of the articles P at the outlet of the chamber 2 takes into account the thermodynamic and physical characteristics of the chamber 2 and of the articles P, and also the operating parameters of the installation.

Consequently, the determination of the temperature of the articles P at the outlet of the chamber 2 is dynamic, parameterizable and very accurate.

Step 20 of predicting the temperature of the articles P at the outlet of the chamber 2 is followed by a step 26 of comparing the temperature predicted during step 20 with the temperature setpoint determined during step 16.

For example, this comparison step 26 takes into account a tolerance interval of the order of a few degrees around the exit temperature setpoint determined during step 16.

When the difference between the predicted temperature and the setpoint is above a predetermined threshold value, comparison step 26 is followed by a step 28 of modifying the operating parameters of the installation.

For example, the operating parameters modified during this step 28 include the speed of the conveyor 6 and the parameters involved in determining the theoretical temperature, profile of the fluid 4 in the chamber 2, i.e. for example the flow rate of the cryogenic fluid 4, the control of the ventilation inside the chamber 2 and the loading factor of the conveyor 6.

The modifications of the operating parameters during step 28 may be carried out directly by an operator or automatically by a computer, taking the maximum and minimum limits for each of the parameters into account.

In addition, the modifications may each time affect one or more parameters.

It is also possible to define an order of modification of the operating parameters in order to try to achieve the setpoint temperature by modifying only one parameter at a time. If the setpoint cannot be achieved by modifying a first parameter between limit values, this parameter is set to a limit value or a mean value, and in the following iterations the next parameter in the list is modified.

After step 28 of modifying the operating parameters, the procedure returns to step 20 of predicting the temperature of the articles P at the outlet of the chamber 2, the procedure thus forming a test cycle for testing the operating parameters of the installation, comprising step 20 of predicting the exit temperature of the articles, step 26 of comparing the predicted temperature with the setpoint temperature and step 28 of modifying the operating parameters.

This test cycle, denoted by the general numerical reference 29, is repeated until the comparison made during step 26, between the predicted temperature and the setpoint temperature reveals a difference below a predetermined threshold value.

The cycle 29 is then interrupted and step 26 is followed by a step 30 of recording the last operating parameters tested, which thus form a recipe.

Since the prediction made during step 20 is very accurate and takes into account the operating parameters of the chamber 2, the thermodynamic and physical characteristics of the chamber 2 and the thermodynamic and physical characteristics of the article P, the recipe determined by the procedure for the invention is accurate and close to the actual operation.

In addition, such a recipe is easily adapted to modifications in the operating conditions.

For example, if an operating parameter such as the temperature of the articles on entering the chamber 2 is modified, the recipe may be corrected by executing the procedure for the invention using the actual recipe parameters as initial operating parameters during step 18, the execution of the procedure for the invention making it possible for the corrections to be made to the operating parameters, in order to obtain the proper exit temperature of the articles P, to be rapidly and simply determined.

Step 20 of predicting the temperature of the articles P at the outlet of the chamber 2 will now be described in greater detail with reference to FIGS. 3, 4 and 5.

Figure 3:
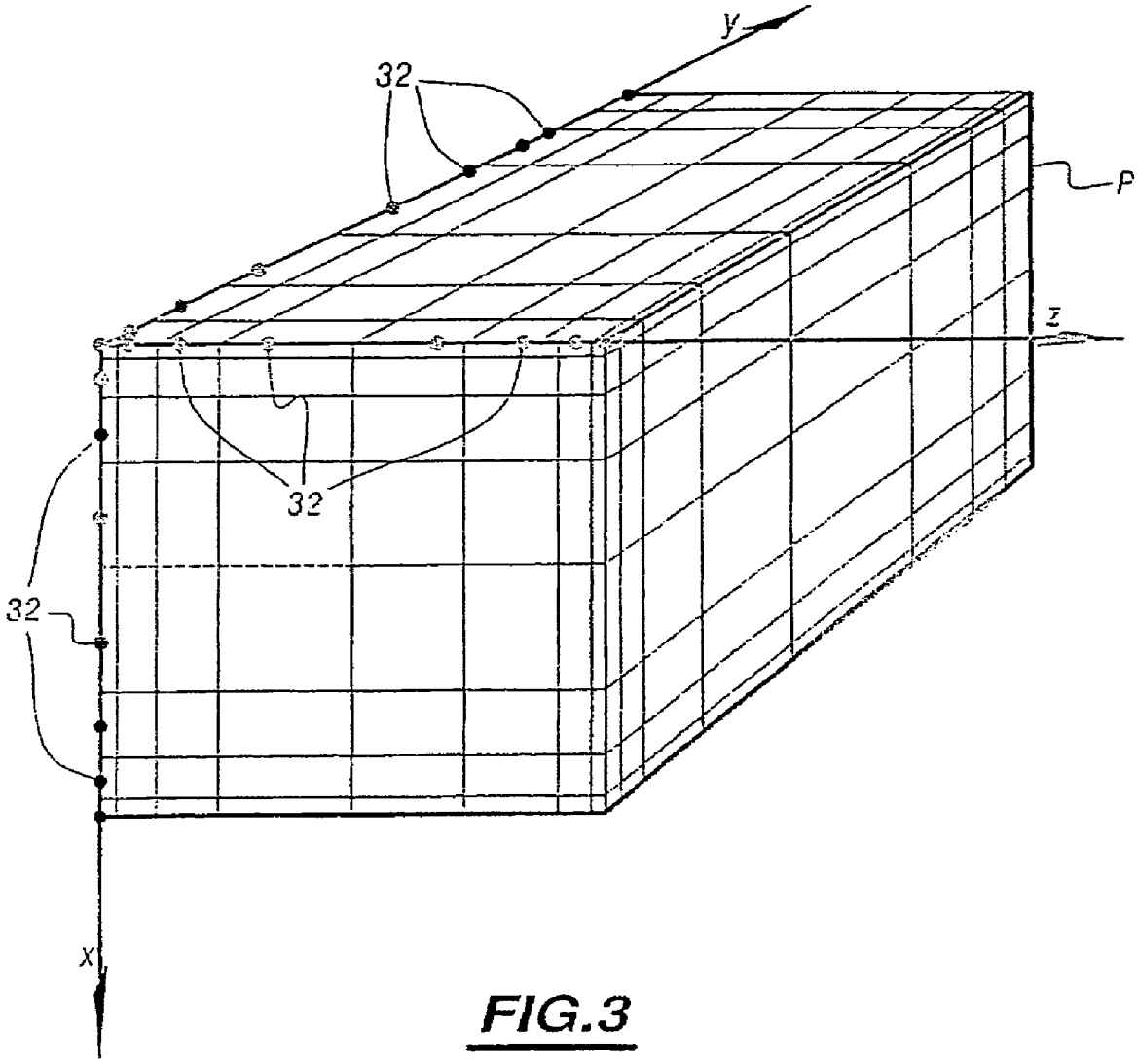
FIG. 3 illustrates according to one embodiment of the current invention, the numerical modeling of an article to be treated.

FIG. 3 shows an example of the mesh for a food article P as employed during step 24 of predicting the behavior of the articles P.

In the procedure for determining the operating parameters, the thermodynamic and physical characteristics of the articles P are taken into account in step 24 of predicting their behavior on the basis of a modeling of the articles P to which the discretized heat conservation equation is applied.

This is because the heat conservation equation cannot be solved at any point in space and at any instant by a simple integral function.

The procedure employed consists in discretizing this equation in such a way that it is solved only at the spatial and temporal points called nodes, these being denoted by the general numerical reference 32.

After defining a mesh for the article P, the heat conservation equation is applied to each of the nodes 32.

What is thus obtained is a system of equations that have to be solved in order to determine the thermal state of the article P both in time and in space:

$$\frac{\partial}{\partial x}\left(\lambda\frac{\partial T}{\partial x}\right)+\frac{\partial}{\partial y}\left(\lambda\frac{\partial T}{\partial y}\right)+\frac{\partial}{\partial z}\left(\lambda\frac{\partial T}{\partial z}\right)=\rho\frac{\partial(C\cdot T)}{\partial t}$$

in which X, Y and Z are axes that define an orthonormal spatial reference frame around the article P, T is the temperature of the article P expressed in kelvin (K) and C is its specific heat expressed in watts per kilogram per kelvin (W/(kg.K)).

The food articles P to be deep-frozen generally consist of different bodies.

This means that the phase change is accompanied by a change in temperature, and that the heat conservation equation may still apply.

However, if it is necessary to treat a pure substance, the equation is no longer continuous. In this case, the problem is simplified by modifying the enthalpy table of the pure substance so that the phase change generates a small change in temperature.

The discretization is carried out using the mathematical method of finite differences in variable mode.

As is known, this may be carried out in two ways.

The first way—implicit discretization—has the advantage of being stable whatever the spatial and temporal configuration. At a given instant, it allows the temperature of a node 32 to be determined as a function of the temperature of the neighboring nodes at the same instant. However, it does involve constant boundary conditions and a matrix solution of the system of equations formed by each of the nodes 32.

The second way—explicit discretization—allows direct determination of the temperature of a node 32 at an instant T+ΔT on the conditions at the instant T. The result is immediate, however it is necessary to choose a suitable step time so as to avoid any instability of the model.

The first method is recommended if it is desired to obtain mainly the surface temperature of an article, which corresponds to the operation commonly referred to as "crust freezing". The second method is recommended when it is desired to deep-freeze an article and to know the temperature in the core thereof.

The mesh for the article P is a crucial problem. On it will depend directly the simplicity of the subsequent processing and the precision of the results.

A large number of nodes that provide great precision in the result, but requires a long computation time. A compromise has to be found between precision and computing time.

For example in the case of a food product having external dimensions of 100×60×10 mm with a regular mesh of cells every millimeter, more than 17000 nodes are required and the same number of equations in order to define the behavior of the article P.

In the described version of the invention, step 24 includes calculations that make it possible to optimize the mesh used for predicting the behavior of the products P.

For example, in the case of crust freezing it is more particularly solidification of thin skin of the product caused by a phase change that is monitored. It is therefore necessary to have a dense mesh around the periphery, but a coarser one in the core.

In order not to manually input the coordinates of each of the nodes and to maintain simple relationships between the nodes and to facilitate the processing, one solution consists in distributing the nodes in each direction in space using, for example, a geometric progression, as shown in FIG. 3.

For example, along the X axis, the nodes are distributed as follows: taking Δx as the value of the first term, which corresponds to the abscissa of the first node, and r as the common ratio, which differs from 1, of the geometric series used, then the value of the nth term is $\Delta x r^{n-1}$, which corresponds to the position on the X axis of the nth node. The sum of the n first terms is:

$$S = \Delta x + \frac{1 - r^n}{1 - r}.$$

FIG. 3 shows the positions of the nodes according to this mesh on a parallelepipedal article P on which a parity condition on the number of nodes has been imposed so as to simplify the solution.

The value corresponding to the length of the product P along the X axis is thus obtained:

$$L_p = \Delta x + \Delta x(1 + r)\frac{1 - r^l}{1 - r} = \Delta x\left(1 + \frac{1}{R}(1 - r^l)\right)$$

where $$R = \frac{1 - r}{1 + r},$$

with 1, which corresponds to the abscissa of the central node on this length, given by:

$$l = \frac{\mathrm{Ln}\left(1 - \left(\frac{L_p}{\Delta x} - 1\right)R\right)}{\mathrm{Ln}(r)}.$$

The imprecision along the X axis is then expressed as follows:

$$-1/2 \le l - \frac{\mathrm{Ln}\left(1 - \left(\frac{L_p}{\Delta x} - 1\right)R\right)}{\mathrm{Ln}(r)} < 1/2 \Leftrightarrow$$

$$L_p - \frac{\Delta x}{R} r^l \left(r^{-\frac{1}{2}} - 1\right) \le \Delta x\left(1 + \frac{1}{R}(1 - r^l)\right) < L_p + \frac{\Delta x}{R} r^l \left(r^{\frac{1}{2}} - 1\right)$$

To result in simple calculations, the imprecisions on the three axes are set to the same value. This introduces an error in the dimensions of the product P that is acceptable if one is only interested in the temperatures over a thin skin and if the core temperatures vary little, as will be the case in crust freezing operations.

In the case of deep-freezing operations, in which the aim is to determine the core temperature of the product; a corrective term may be inserted into the formulae. In the case of the X axis, the following corrective term is inserted:

$$\Delta x^l = \frac{L_p}{\left(1 + \frac{1}{R}(1 - r^l)\right)}$$

Another possible optimization method consists in reducing the processing time by omitting certain calculations.

Specifically, on each node, the heat flux is added to the six faces of its elementary volume. However, there are zones in which the thermal effects can be likened to one-dimensional problems.

To exploit this particular feature, the processing is broken down by summing no longer the overall thermal fluxes on each face, but in each direction. A time interval ΔT, the equations at the nodes are solved in each direction by going from the boundary towards the core, until the enthalpy change is considered as being negligible, since it is below a predetermined threshold value.

By carrying out this operation in each direction, a volume of the product P encompassing all the nodes for which the enthalpy changes will be negligible, and therefore for which no calculation will be carried out, is defined.

It is thus possible to save computing time, in particular over the first few moments of the exchange.

If the article P is of complex shape, it may be decomposed into a set of elementary shapes to which the mesh defined above, or any other mesh suitable for the shape of the article P, is applied.

Figure 4:
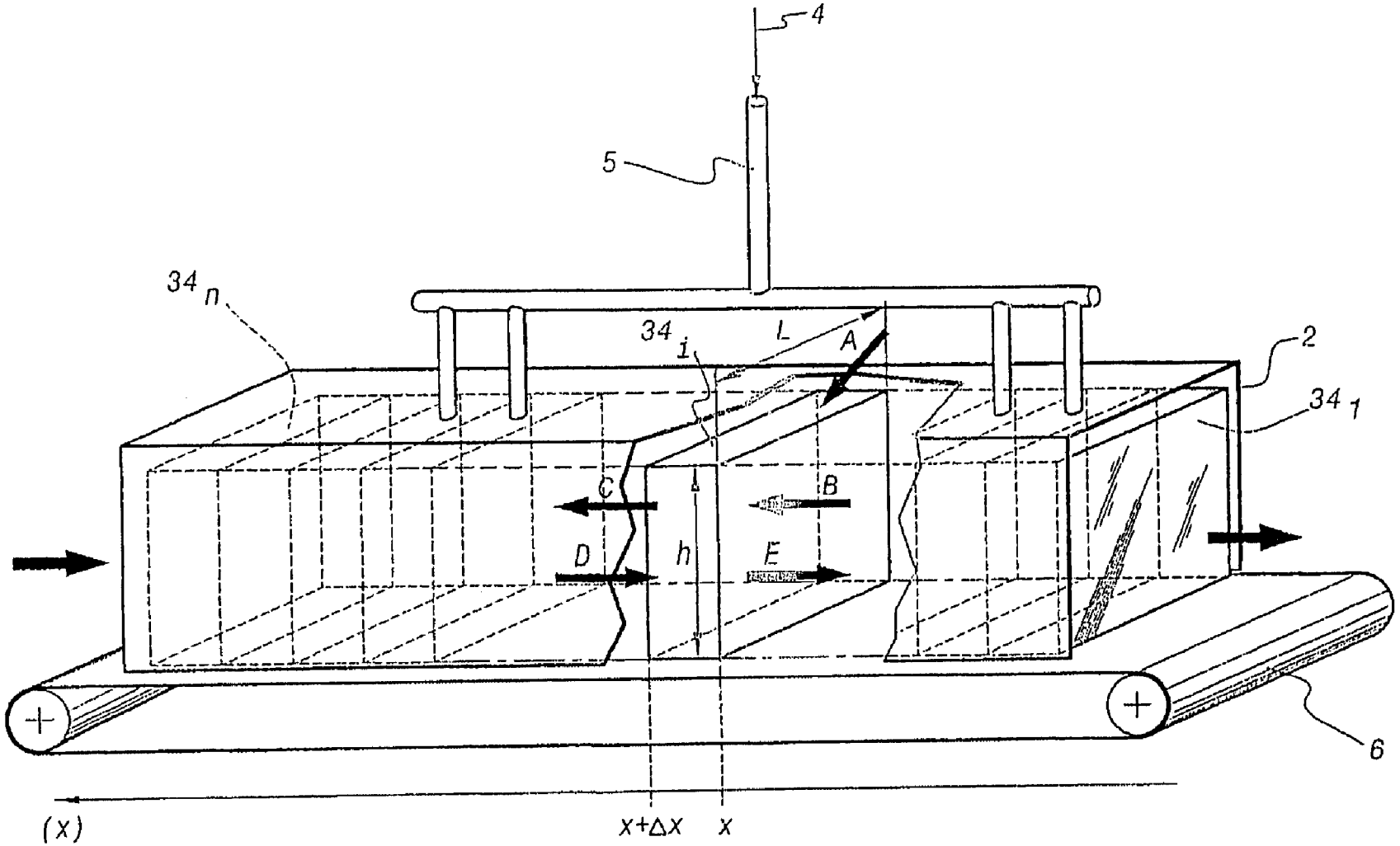
FIG. 4 illustrates according to one embodiment of the current invention, the numerical modeling of a cooling chamber.

FIG. 4 shows schematically the chamber 2 for treating the food articles P, as modeled for implementing step 22 of predicting its behavior.

In the procedure for determining the operating conditions, the thermodynamic and physical characteristics of the chamber 2 are taken into account during step 22 of predicting the behavior of the chamber 2 on the basis of its model in the form of elementary slices.

As described previously with reference to FIG. 1, the cooling chamber 2 is associated with a conveyor 6. The chamber is supplied with cryogenic fluid 4 via a feed line 5. The chamber 2 can be likened to a rectangular parallelepiped.

To determine the theoretical temperature profile of the fluid 4, the method used to predict the behavior of the chamber 2 consists in carrying out a succession of local heat balances.

For this purpose, the thermodynamic system of the chamber 2, in the steady state, is modeled in the form of elementary slices $\mathbf{34}_1$, to $^{34}{}_n$ perpendicular to its length. The sum of these elementary slices $\mathbf{34}_1$ to $\mathbf{34}_n$ represents the internal volume of the chamber 2.

For each elementary slice $\mathbf{34}_1$ to $\mathbf{34}_n$, the heat transfer balance is made, so as to determine the enthalpy of the fluid 4 and therefore its temperature.

This balance must take into account the following:

the thermal losses with the outside of the chamber 2;

the cryogenic liquid 4 injected into the spray zones; and the heat exchange between the products P and the fluid 4.

In the case of the slice $\mathbf{34}_i$ of the chamber 2, having dimensions L×l×h, the thermal balance is given by the following equation:

$$H_{fs(i)} = H_{fe(i)} + \frac{2K_r(l+h)(T_{Amb} - T_{fe(i)})\Delta X - \Delta\dot{m}_{dSpray(i)} * (H_{fe(i)} - H_{fLiq}) + \dot{m}_p(H_{pe(i)} - H_{ps(i)})}{\dot{m}_{fe(i)} + \Delta\dot{m}_{dSpray(i)}}$$

In this equation:

$H_{fs(i)}$ corresponds to the enthalpy of the cryogenic fluid 4 on leaving the elementary slice $\mathbf{34}_i$, expressed in joules per kilogram (J/kg);

$H_{fe(i)}$ image of 14/1] corresponds to the enthalpy of the cryogenic fluid 4 on entering the elementary slice $\mathbf{34}_i$, expressed in joules per kilogram (J/kg);

$H_{fLiq}$ corresponds to the enthalpy liquid of the injected cryogenic fluid 4, expressed in joules per kilogram (J/kg);

$H_{pe(i)}$ corresponds to the enthalpy of the article P on entering the slice $\mathbf{34}_i$, expressed in joules per kilogram (J/kg);

$H_{ps(i)}$ corresponds to the enthalpy of the article P on leaving the slice $\mathbf{34}_i$, expressed in joules per kilogram (J/kg);

$K_T$ corresponds to the heat exchange coefficient for exchange between the chamber 2 and the outside, expressed in watts per square meter per kelvin (W/(m$^2$K));

$\dot{m}_{fSpray(i)}$ corresponds to the mass flow rate of the cryogenic fluid 4 vaporized in the slice $\mathbf{34}_i$, expressed in kilograms per second (kg/s);

$\dot{m}_{fe(i)}$ corresponds to the mass flow rate of cryogenic fluid 4 entering the slice $\mathbf{34}_i$, expressed in kilograms per second (kg/s);

$\dot{m}_p$ corresponds to the mass flow rate of products to be treated, expressed in kilograms per second (kg/s);

$T_{Amb}$ corresponds to the ambient temperature, expressed in kelvin; and $T_{fe(i)}$ corresponds to the temperature of the cryogenic fluid 4 entering the slice $\mathbf{34}_i$, expressed in kelvin.

FIG. 4 also shows the following thermal fluxes:

$\dot{m}_{fSpray(i)}H_{fLiq}$ represented by the letter A;

$\dot{m}_{fe(i)}H_{fe(i)}$ is represented by the letter B;

$\dot{m}_{fs(i)}H_{fs(i)}$ is represented by the letter C;

$\dot{m}_pH_{pe(i)}$ is represented by the letter D; and $\dot{m}_pH_{ps(i)}$ is represented by the letter E, where $\dot{m}_{fs(i)}=\dot{m}_{fe(i)}+\Delta\dot{m}_{fSpray(i)}$.

From experience, it is known that, under certain operating conditions (too low a production rate or too low a temperature of the cryogenic fluid 4), the injected cryogenic fluid 4 is only partly vaporized and a fraction of the liquid flows away toward the inlet of the chamber 2.

If it is desired to take this phenomenon into account, it is preferable to solve the local balance equations by starting with the elementary slice located at the outlet of the chamber 2. The calculations are therefore performed in the opposite sense to the path of the articles P, i.e. along the X axis as shown in FIG. 4.

This is because, in this direction, the fraction of unvaporized liquid can be transferred into the next slice and so on, until the ventilation zones are reached, where the injected flow rates are zero and where the surplus liquids are vaporized.

To determine the fraction of unvaporized cryogenic liquid 4 in an elementary slice, a limiting fluid enthalpy is denoted, below which it will appear as liquid.

This amounts to setting a minimum gaseous fluid temperature in the chamber 2.

The unvaporized liquid content on leaving the elementary slice $\mathbf{34}_i$ corresponds to $\chi_{L(i)}$ and is expressed in the following form:

$$x_{L(i)} = \frac{\dot{m}_{fLiq(i)}}{\dot{m}_{fs(i)}}$$

If the calculations are simplified by considering that the enthalpy of this liquid fraction is approximately equal to the enthalpy of the injected cryogenic fluid 4, the following expression for the amount of liquid is obtained:

$$x_L = \frac{(H_{fLim} - H_{fs})}{(H_{fLim} - H_{fLiq})}.$$

In this equation, $H_{fLim}$ corresponds to the limiting enthalpy of formation of an amount of liquid in an elementary slice of the chamber 2.

Figure 5:
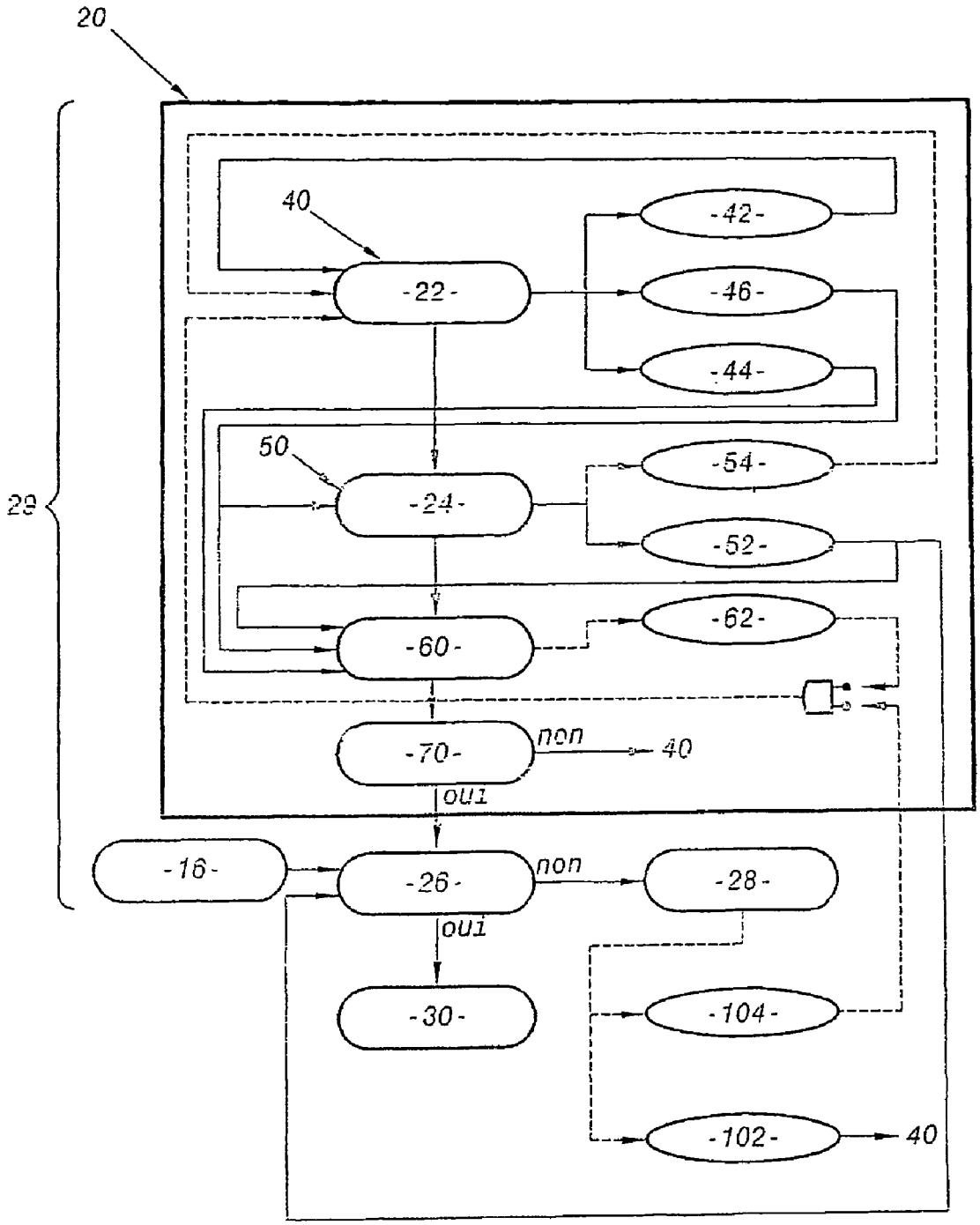
FIG. 5 illustrates a schematic representation, according to one embodiment of the current invention, of a test cycle.

FIG. 5 shows the details of the test cycle 29 and in particular step 20 of predicting the temperature of the articles P at the outlet of the chamber 2.

To be able to predict the temperature of the articles P of the outlet of the chamber 2, the cooling procedure involves step 22 of predicting the behavior of the chamber 2 and step 24 of predicting the behavior of the articles P.

The test starts by carrying out step 22 of predicting the behavior of the chamber 2, during a step 40.

This step 40 delivers the heat losses 42 per elementary slice, these being reintroduced into step 22.

After this operation has been reiterated a certain number of times, the total heat losses 44 and the temperature profile 46 of the fluid 4 in the chamber 2 are obtained during step 40.

To calculate the heat balance for each slice, step 22 requires the enthalpy changes of the articles P. Because, during the first iteration, the temperature profile of the fluid 4 in the chamber 2 cannot be calculated, it is set arbitrarily.

Next, step 24 of predicting the behavior of the articles P is carried out during a step 50. This step 50 delivers the enthalpy 52 of the article P at the outlet of the chamber 2, i.e. its temperature.

Optionally, step 24 of predicting the behavior of the articles P also delivers the enthalpy changes 54 of an article P for each elementary slice of the chamber 2. In this case, this datum is sent back to step 22 of predicting the behavior of the chamber 2, which inserts it into the thermal balance equation for each elementary slice.

The enthalpy 52 of the article P at the outlet of the chamber 2, the temperature profile 46 of the fluid 4 in the chamber 2 and the total heat losses 44 are put into the relationship, at step 60, so as to determine the total flow rate of the fluid.

Optionally, the flow rate 62 of fluid injected into each elementary slice is also obtained. In this case, this datum is sent back to step 22 of predicting the behavior of the chamber 2, which inserts it into the heat balance equation for each elementary slice.

Next, a check is made at step 70 to determine whether the temperature profile of the fluid 4 in the chamber 2 is stable.

For example, the temperature profile of the fluid is considered as stable if it meets, twice in succession, the following criterion:

$$\frac{H_{ps(1,k)} - H_{ps(1,k-1)}}{H_{ps(1,k)}} \leq \text{dif_profile}$$

In this equation, dif_profile is a constant set by the operator.

The profile is considered as unstable for the first pass.

As long as the profile is considered as unstable, the procedure returns to step 40 and the succession of operations for defining a profile is repeated.

Once a stable profile has been obtained, a check is made during step 26 to determine whether the setpoint determined during step 26, relating to the temperature of the articles P at the outlet of the chamber 2, has been reached.

If the setpoint has been reached, the operating parameters resulting in the final temperature profile of the fluid 4 inside the chamber 2 are recorded during step 30 and these form a recipe.

If the setpoint has not-been reached, the operating parameters of the installation are modified at step 28. For example, this modification includes a correction 102 to the flow rate of the fluid 4 before reiteration of the algorithm. Optionally, the modification includes a correction 104 made directly to the operating parameters that determine the temperature profile of the fluid 4, which is used in step 22 to predict behavior of the chamber 2.

In this example, the predicted temperature of the articles at the outlet of the chamber is used to determine the flow rate of the fluid 4 injected into a cryogenic chamber 2.

In the same way, it is possible to vary the residence time of the articles P in the chamber 2 by modifying the speed of the conveyor 6 or the stop times in the case of a sequential conveyor. It is also possible to vary the gas extraction rate or the loading factor, or a combination of these parameters.

Likewise, it is possible to vary the balance between the amount of incoming air, and the amount of outgoing gas, the gas extraction rate, the gas speed-up, or the gas recirculation by acting on the elements for controlling these parameters.

Moreover, if the procedure of the invention is used for an installation employing contactless sensors for measuring the exit temperature of the articles, for example sensors based on thermal radiation or infrared imaging, or else based on an MWT (microwave thermometry) measurement, such as the sensor described in patent FR-A-2 771 552, the results delivered during the step of predicting the temperature of the articles at the outlet of the chamber can then be crosschecked with the measurements delivered by these sensors.

In this case, one or other of the information items is used to verify the other.

In one embodiment, the information delivered by the sensor is used to correct the prediction.

Although one particular embodiment has been described, this should not be considered as limiting the scope of the present invention.

As a variant, the cooling procedure of the invention may also be applied in a mechanical refrigeration installation having an indirect heat exchange device.

The invention has been described in the case of cooling food articles, however it may also be applied to other types of articles, especially metal articles.

In addition, the term "cooling" also covers systems aimed at maintaining and controlling a temperature below the initial temperature of an article.

The procedure of the invention may be implemented using, for example, a program executed on a computer or any other suitable software and/or hardware approach.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method which may be used for determining the operating parameters of an installation for the cooling of articles, said method comprising:

a) providing an installation for cooling articles, wherein said installation comprises:
   1) a chamber with an inlet and an outlet; and
   2) a cooling fluid;

b) determining a temperature set point for said articles at said outlet;

c) determining initial operating parameters for said installation; and d) performing a test cycle to test said operating parameters, wherein said test cycle comprises:
   1) predicting a temperature of said articles at said outlet, wherein said prediction is made on the basis of:
      i) the operating parameters of said chamber;
      ii) the thermodynamic and physical characteristics of said chamber; and
      iii) the thermodynamic and physical characteristics of said articles;
   2) comparing said temperature set point with said predicted temperature; and
   3) modifying said operating parameters, when said comparison reveals a difference between said predicted temperature and said temperature set point.

2. The method of claim 1, wherein said predicting said temperature further comprises predicting the behavior of said chamber based on the solution of heat balance equations on elementary volume slices of said chamber, based at least on the basis of:

a) thermodynamic characteristics of said cooling fluid; and b) thermodynamic and physical characteristics of said chamber.

3. The method of claim 2, further comprising predicting the behavior of said chamber based upon said operating parameters of said installation.

4. The method of claim 3, wherein said operating parameters comprise at least one member selected from the group consisting of:

a) the speed of a conveyor transporting said articles through said chamber;

b) the loading factor; and c) the ventilation of the atmosphere in said chamber.

5. The method of claim 2, wherein predicting said temperature further comprises predicting the behavior of said articles based upon solving a discretized heat conservation equation, as applied to a grid of spatial and temporal points which constitute a mesh of said articles, based at least on the basis of said thermodynamic and physical characteristics of said articles.

6. The method of claim 5, wherein said predicting the behavior of said articles is carried out on the basis of said operating parameters of said installation.

7. The method of claim 6, wherein said operating parameters of said installation comprise the temperature of said articles at said outlet.

8. The method of claim 5, further comprising optimizing said predicting of the behavior of said articles through calculations involving the modification of said mesh of said articles using mathematical series.

9. The method of claim 8, wherein said optimizing further comprises omitting the prediction calculations for spatial and temporal points of said mesh of said articles for which the enthalpy changes are below a predetermined threshold value.

10. The method of claim 5, wherein predicting said temperature further comprises is based on both predicting the behavior of said chamber and on predicting the behavior of said articles.

11. The method of claim 1, wherein modifying said operating parameters comprises manually modifying at least one operating parameter.

12. The method of claim 1, wherein modifying said operating parameters comprises automatically modifying at least one operating parameter.

13. The method of claim 1, wherein modifying said operating parameters comprises modifying at least one member selected from the group consisting of:

a) the flow rate of said cooling fluid;

b) the residence time of said articles in said chamber;

c) the flow rate of gas extracted from said chamber;

d) the gas speed-up rate;

e) the gas recirculation rate; and f) the balance between the amount of incoming air and the amount of outgoing gas.

14. A method which may be used for determining the operating parameters of an installation for the cooling of articles, said method comprising:

a) providing an installation for cooling articles, wherein said installation comprises:

1) a chamber with an inlet and an outlet; and 2) a cooling fluid;

b) determining a temperature set point for said articles at said outlet;

c) determining initial operating parameters for said installation; and d) performing a test cycle to test said operating parameters, wherein said test cycle comprises:

1) predicting a temperature of said articles at said outlet, wherein:

i) said prediction is made on the basis of:

aa) the operating parameters of said chamber;

bb) the thermodynamic and physical characteristics of said chamber; and cc) the thermodynamic and physical characteristics of said articles; and ii) said predicting comprises predicting the behavior of said chamber based on the solution of heat balance equations on elementary volume slices of said chamber, based at least on the basis of:

aa) thermodynamic characteristics of said cooling fluid; and bb) thermodynamic and physical characteristics of said chamber;

2) comparing said temperature set point with said predicted temperature; and 3) modifying said operating parameters, when said comparison reveals a difference between said predicted temperature and said temperature set point, wherein said operating parameters comprise at least one member selected from the group consisting of:

i) the flow rate of said cooling fluid;

ii) the residence time of said articles in said chamber;

iii) the flow rate of gas extracted from said chamber;

iv) the gas speed-up rate;

v) the gas recirculation rate; and vi) the balance between the amount of incoming air and the amount of outgoing gas.

15. A method which may be used for determining the operating parameters of an installation for the cooling of articles, said method comprising:

a) providing an installation for cooling articles, wherein said installation comprises:

1) a chamber with an inlet and an outlet; and 2) a cooling fluid;

b) determining a temperature set point for said articles at said outlet;

c) determining initial operating parameters for said installation; and d) performing a test cycle to test said operating parameters, wherein said test cycle comprises:

1) predicting a temperature of said articles at said outlet, wherein:

i) said prediction is made on the basis of:

aa) the operating parameters of said chamber;

bb) the thermodynamic and physical characteristics of said chamber; and cc) the thermodynamic and physical characteristics of said articles; and ii) said predicting comprises:

aa) predicting the behavior of said chamber based on the solution of heat balance equations on elementary volume slices of said chamber, based at least on the basis of:

aaa) thermodynamic characteristics of said cooling fluid; and bbb) thermodynamic and physical characteristics of said chamber; and bb) predicting the behavior of said articles based upon solving a discretized heat conservation equation, as applied to a grid of spatial and temporal points which constitute a mesh of said articles, based at least on the basis of said thermodynamic and physical characteristics of said articles;

2) comparing said temperature set point with said predicted temperature; and 3) modifying said operating parameters, when said comparison reveals a difference between said predicted temperature and said temperature set point.

* * * * *